United States Patent [19]

Shigeru et al.

[11] Patent Number: 4,490,433

[45] Date of Patent: Dec. 25, 1984

[54] PROCESS FOR PRODUCING ANTISTATIC CARPET

[75] Inventors: Futami Shigeru, Ibaraki; Tajiri Koji, Mihara; Hayashi Kazushige, Tokyo, all of Japan

[73] Assignee: Teijin Limited, Osaka, Japan

[21] Appl. No.: 496,060

[22] Filed: May 19, 1983

[30] Foreign Application Priority Data

May 24, 1982 [JP] Japan ..... 57-86492
May 24, 1982 [JP] Japan ..... 57-86493

[51] Int. Cl.[3] ..... B05D 3/06

[52] U.S. Cl. ..... 428/262; 427/44; 427/54.1; 427/393.1

[58] Field of Search ..... 427/44, 54.1, 393.1; 428/262, 500

[56] References Cited

U.S. PATENT DOCUMENTS

| | | | |
|---|---|---|---|
| 2,839,431 | 6/1958 | Rimmer | 427/393.1 |
| 2,841,567 | 7/1958 | Blanton et al. | 427/393.1 |
| 4,079,042 | 3/1978 | Topfl et al. | 427/393.1 |
| 4,248,685 | 2/1981 | Beede et al. | 204/159.22 |

*Primary Examiner*—John H. Newsome
*Attorney, Agent, or Firm*—Burgess, Ryan & Wayne

[57] ABSTRACT

An antistatic carpet having an excellent durability is produced by a process comprising impregnating only a surface portion of a carpet with a precursory antistatic material consisting essentially of at least one member selected from the group consisting of (A) diacrylate compounds of the formulae (I) and (II):

(I)

-continued (II)

wherein R and $R^1$ represent a hydrogen atom or a methyl radical, $R^2$ represents a divalent radical selected from those of the formulae:

m and m′ represent zero or an integer of from 1 to 100 and n and n′ represent zero or an integer of from 1 to 200, when one of m and n is zero, the other being not zero, and when one of m′ and n′ is zero, the other being not zero, (B) mixture of at least one diacrylate compound selected from those of the formulae (I) and (II) with at least one monomeric compound having at least one ethylenically unsaturated bond and capable of reacting with the diacrylate compound, and (C) mixtures of at least one monoacrylate compound selected from those of the formula (III):

(III)

wherein one of $R^3$ and $R^4$ represents a radical of the formula (IV):

(Abstract continued on next page.)

PROCESS FOR PRODUCING ANTISTATIC CARPET

BACKGROUND OF THE INVENTION (1) Field of the Invention

The present invention relates to a process for producing an antistatic carpet, more particularly, to a process for producing an antistatic carpet having enhanced durability in the antistatic property thereof.

(2) Description of the Prior Arts

When a person walks on a conventional carpet having a pile surface layer thereof consisting of synthetic polymer fiber yarns or wool yarns, the friction between the carpet surface and the soles of the shoes of the person generates an amount of static electricity which is charged to the person's body. When the person comes into contact with a metallic door knob, the static electricity discharges from the person. This discharge frequently results in a strong electrical shock.

In order to eliminate the above-mentioned disadvantage, various attempts have been made to blend electroconductive fibers in the pile yarns in the carpet. Known electroconductive fibers include metal fibers, organic fibers plated with a conductive metallic material, organic fibers coated with a mixture of an electroconductive substance with a polymeric matrix material, and organic fibers containing therein carbon black particles.

The above-mentioned conventional electroconductive fibers have come into wide use by industry. The conventional fibers, however, have their inherent disadvantages. For example, metal fibers exhibit no or very poor flexual recovery. Therefore, when the metal fibers are repeatedly bent in use or processing thereof, the electroconductivity of the metal fibers significantly decreases. Also, metal fibers are difficult to blend in other types of fibers. Furthermore, the inherent specific color of the metal fibers sometimes degrades the color of the carpet pile layer containing, as a major component, organic fibers dyed in a light color.

As for metal-plated organic fibers, the plated metal layers formed on the organic fiber surfaces should be even and continuous. Therefore, the organic fibers to be plated are required to have a smooth and even surface. Only specific types of organic fibers meet the above-mentioned requirement. Also, the plated metal layer sometimes easily peels off from the organic fiber surface and, therefore, exhibits poor durability. Furthermore, the plated metal layer has a specific color inherent to the plated metal. This specific color of the metal layer is sometimes undesirable.

In the case of conductive fibers in which the organic fiber surfaces are coated with a mixture dope of an electroconductive substance with a polymeric matrix material, the coating layer sometimes easily separates from the organic fiber surface and exhibits an undesirable color derived from the electroconductive substance.

With carbon black-containing electroconductive fibers, the fibers have to contain at least 15% by weight of carbon black to obtain a satisfactory degree of electroconductivity. This large amount of carbon black causes the resultant fibers to be black or dark gray. Accordingly, when the carbon black-containing fibers are used in the pile layer of the carpet which contains, as a major component, light color-dyed organic fibers, the specific dark color of the carbon black-containing fibers degrades the color of the resultant carpet.

It has also been attempted to apply a rubber latex containing electroconductive carbon fibers onto a lower surface of the carpet to provide an electroconductive backing layer.

In another attempt, the electroconductive fibers are blended in a substrate layer on which the pile layer is formed.

However, the conventional carbon fiber-containing backing layer and the conventional electroconductive fiber-containing substrate layer fail to provide a satisfactory degree of antistatic property to carpets.

SUMMARY OF THE INVENTION

An object of the present invention is to provide a process for producing an antistatic carpet having an excellent antistatic property and an enhanced durability.

Another object of the present invention is to provide a process for producing an antistatic carpet without degrading the appearance and color of the carpet.

A still another object of the present invention is to provide a process for producing an antistatic carpet without using special electroconductive fibers.

The above-mentioned objects can be attained by the process of the present invention, which comprises the steps of uniformly impregnating only a surface portion of a carpet with a precursory antistatic material consisting essentially of at least one member selected from the group consisting of (A) bi-functional compounds of the formulae (I) and (II):

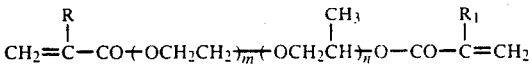

(I)

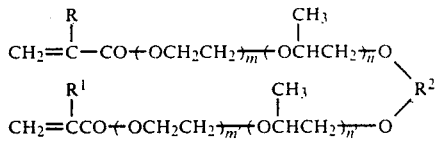

(II)

wherein R and $R^1$ represent, independently from each other, a member selected from the group consisting of a hydrogen atom and a methyl radical, $R^2$ represents a divalent radical selected from the group consisting of those of the formulae:

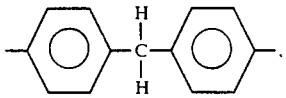

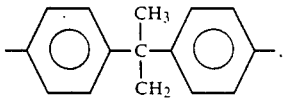

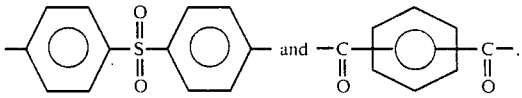

m and m′ represent, independently from each other, zero or an integer of from 1 to 100 and n and n′ represent, independently from each other, zero or an integer of from 1 to 200, when one of m and n is zero, the other being not zero, and when one of m′ and n′ is zero, the other being not zero, (B) mixtures of at least one bi-functional compound selected from those of the formulae (I) and (II) with at least one compound having at least one ethylenically unsaturated bond and capable of reacting with the bi-functional compound, and (C) mixtures of at least one mono-functional compound selected from the group consisting of those of the formula (III):

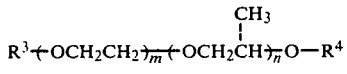

(III)

wherein one of $R^3$ and $R^4$ represents a radical of the formula (IV):

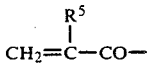

(IV)

and the other represent a member selected from the group consisting of a hydrogen atom and inorganic and organic radicals different from those of the formula (IV), m and n are as defined above, and $R^5$ in the formula (IV) represents a member selected from the group consisting of a hydrogen atom and a methyl radical, with at least one compound having at least two ethylenically unsaturated bonds and capable of copolymerizing with the mono-functional compounds; and applying a cross-linking treatment to the precursory antistatic material to cure it.

DESCRIPTION OF THE PREFERRED EMBODIMENT

Figure 1:
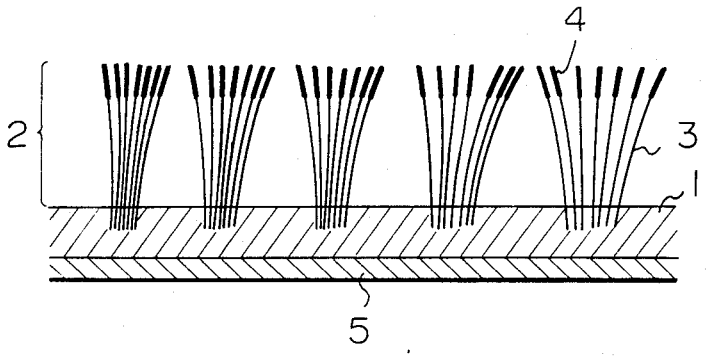
FIG. 1 is an explanatory cross-sectional side view of an antistatic carpet produced in accordance with the process of the present invention.

In the process of the present invention for producing an antistatic carpet, only the surface portion of the carpet is uniformly impregnated with a precursory antistatic material.

The carpet usable for the present invention is one with a pile surface layer formed on a substrate sheet layer. The pile surface layer may consist of loop piles or cut piles. The pile surface layer and the substrate sheet layer may be composed of synthetic fiber yarns, for example, polyester, polyamide, polyolefin, or polyacrylic fiber yarns; natural fiber yarns, for example, cotton yarns, wool yarns, or flax yarns; or yarns consisting of two or more of the above-mentioned synthetic and natural fibers. The present invention is particularly useful when nylon fiber yarns are used for forming the pile surface layer.

The carpet is subjected to a precursory antistatic material-impregnating operation. Before the impregnating operation, the surface portion of the carpet may be chemically or physically activated by applying thereto radiation, ultraviolet rays, or an electric discharge. The surface of the carpet to be treated in accordance with the process of the present invention may also be treated with a water repellent and/or softening agent before applying the process of the present invention.

The antistatic material usable for the present invention consists essentially of at least one member selected from the group consisting of (A) bi-functional compounds of the formulae (I) and (II):

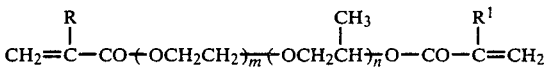

(I)

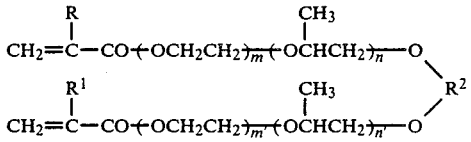

(II)

wherein R and $R^1$ represent, independently from each other, a member selected from the group consisting of a hydrogen atom and a methyl radical, $R^2$ represents a divalent radical selected from the group consisting of those of the formulae:

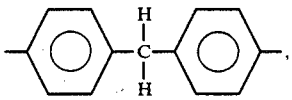

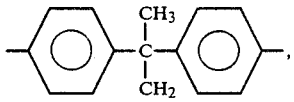

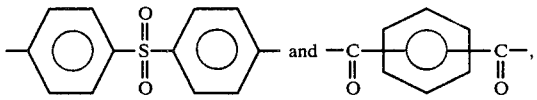

m and m′ represent, independently from each other, zero or an integer of from 1 to 100 and n and n′ represent, independently from each other, zero or an integer of from 1 to 200, when one of m and n is zero, the other being not zero, and when one of m′ and n′ is zero, the other being not zero, (B) mixtures of at least one bi-functional compound selected from those of the formulae (I) and (II) with at least one compound having at least one ethylenically unsaturated bond and capable of reacting with the bi-functional compound, and (C) mixtures of at least one mono-functional compound selected from the group consisting of those of the formula (III):

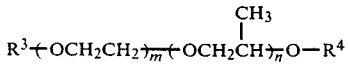

(III)

wherein one of $R^3$ and $R^4$ represents a radical of the formula (IV):

$$CH_2{=}C(R^5){-}CO{-} \quad \text{(IV)}$$

and the other represent a member selected from the group consisting of a hydrogen atom and inorganic and organic radicals different from those of the formula (IV), m and n are as defined above, and $R^5$ in the formula (IV) represents a member selected from the group consisting of a hydrogen atom and a methyl radical, with at least one monomeric compound having at least two ethylenically unsaturated bonds and capable of copolymerizing with the mono-functional compound.

The bi-functional compounds of the formula (I) usable for the present invention include ethyleneglycol diacrylate, ethyleneglycol dimethacrylate, diethyleneglycol diacrylate, diethyleneglycol dimethacrylate, and polyglycol compounds of the formulae:

$$CH_2{=}C(CH_3){-}C(=O){-}(O{-}CH_2CH_2)_{13}{-}O{-}C(=O){-}C(CH_3){=}CH_2$$

$$CH_2{=}C(CH_3){-}C(=O){-}(O{-}CH_2CH_2)_{9}{-}O{-}C(=O){-}C(CH_3){=}CH_2$$

$$CH_2{=}C(CH_3){-}C(=O){-}(O{-}CH_2CH_2)_{23}{-}O{-}C(=O){-}C(CH_3){=}CH_2$$

$$CH_2{=}CH{-}C(=O){-}(O{-}CH_2CH_2)_{13}{-}O{-}C(=O){-}CH{=}CH_2$$

$$CH_2{=}CH{-}C(=O){-}(O{-}CH_2CH_2)_{14}{-}O{-}C(=O){-}CH{=}CH_2$$

$$CH_2{=}CH{-}C(=O){-}(O{-}CH_2CH_2)_{23}{-}O{-}C(=O){-}CH{=}CH_2$$

$$CH_2{=}CH{-}C(=O){-}(O{-}CH_2CH_2)_{150}{-}O{-}C(=O){-}CH{=}CH_2$$

$$CH_2{=}CH{-}C(=O){-}(O{-}CH_2CH_2)_{13}{-}(O{-}CH_2CH(CH_3))_{2}{-}O{-}C(=O){-}CH{=}CH_2$$

-continued and $$CH_2{=}CH{-}C(=O){-}(O{-}CH_2CH_2)_{40}{-}(O{-}CH_2CH(CH_3))_{20}{-}O{-}C(=O){-}CH{=}CH_2$$

The bi-functional compounds of the formula (II) include bis (oxyethylene bis-phenol A) diacrylate, bis (oxyethylene-bisphenol A) diacrylate, bis (oxypropyl-bisphenol A) diacrylate, bis (oxypropyl-bisphenol A) dimethacrylate, and compounds of the formulae:

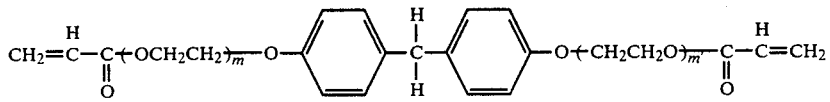

wherein m and m′ represent, independently from each other, zero or an integer of 1 to 6, the sum of m and m′ being 6,

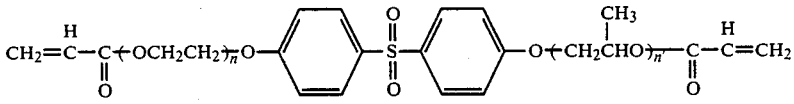

wherein n and n′ represent, independently from each other, zero or an integer of 1 to 10, the sum of n and n′ being 10, and

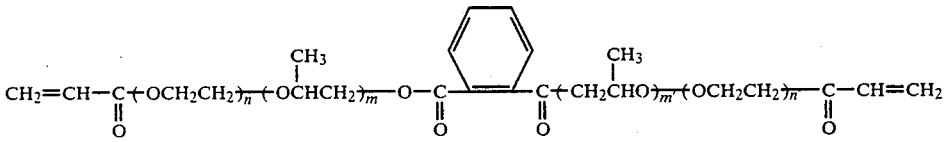

wherein m, m′, n, and n′ respectively represent, independently from each other, zero or an integer of 1 to 13, the sum of m, m′, n, and n′ being 14, the sum of m and n being 1 or more, and the sum of m′ and n′ being 1 or more.

In the mixture (B), the unsaturated compounds to be mixed with the bi-functional compound selected from those of the formulae (I) and (II) include styrene, vinylpyridine, acrylic acid, 2-hydroxyethyl methacrylate, carbitol acrylate, cyclohexyl methacrylate, tetrahydrofurfuryl acrylate, cyanoethyl methacrylate, 2,2-hydroxyethyl acryloyl phosphate, N-methylolacrylamide, N,N′-dimethyl acrylamide, diacetone acrylamide, methyl methacrylate, 2-ethylhexyl methacrylate, lauryl methacrylate, polyethyleneglycol monoacrylate, polypropyleneglycol monomethacrylate, glycidyl methacrylate, dimethylaminoethyl methacrylate, allylglycidylether, acryloyloxyethyl hydrogene acrylate, β-hydroxyethyl-β′-acryloyloxyethyl phthalate and bis-polyoxyethylene bisphenol A-monoacrylate, vinylbenzene, bis (4-acryloxypolyethoxyphenyl) propane, 1,3-butyleneglycol diacrylate, 1,5-pentanediol diacrylate, neopentaneglycol diacrylate, 1,6-hexanediol diacrylate, 1,6-hexanediol diacrylate, pentaerythritol triacrylate, trimethylolpropane triacrylate, tetramethylolmethane tetraacrylate, N,N′-dimethylacrylamide, N,N′-methylene-bis-acrylamide, neopentylglycol dimethacrylate, bis (oxypropylene bis-phenol) diacrylate, trimethylolpropane trimethacrylate, trimethylolethane trimethacrylate, aluminum methacrylate, zinc methacrylate, calcium methacrylate, magnesium methacrylate, diacrylphthalate, triarylcyanurate, triarylisocyanurate, triaryltrimellitate, and ethyleneglycol-diglycidylether acrylate.

In the mixture (B), it is preferable that the molar ratio of the bi-functional compound of the formula (I) and/or (II) to the ethylenically unsaturated monomeric compound be in the range of 40:60 to 90:10, more preferably, 60:40 to 80:20.

In the mixture (C), the mono-functional compounds of the formula (III) include methoxyethylacrylate, methoxymethylmethacrylate, ethoxyethylacrylate, ethoxyethylmethacrylate, butoxyethylacrylate, butoxyethylmethacrylate, methoxyethoxyethylacrylate, methoxyethoxyethylmethacrylate, 2-hydroxyethylacrylolyphosphate, 2-hydroxyethylmethacryloylphosphate, 2-hydroxyethylacrylate, 2-hydroxyethylmethacrylate, ethylcarbitol acrylate, ethylcarbitol methacrylate, methyltetraglycol acrylate, and methyltetraglycol methacrylate.

In the mixture (C), the compound having two or more ethylenically unsaturated bonds include divinylbenzene, bis (4-acryloxypolyethoxyphenyl) propane, 1,3-butyleneglycol diacrylate, 1,5-pentanediol diacrylate, neopentylglycol diacrylate, 1,6-hexanediol diacrylate, diethyleneglycol diacrylate, triethyleneglycol diacrylate, tetraethyleneglycol diacrylate, pentaerythritol triacrylate, trimethylolpropane triacrylate, tetramethylolmethane tetraacrylate, N,N'-dimethylacrylamide, N,N'-methylene bis-acrylamide, ethyleneglycol dimethacrylate, neopentylglycol dimethacrylate, diethyleneglycol dimethacrylate, triethyleneglycol dimethacrylate, dipropyleneglycol dimethacrylate, polypropyleneglycol dimethacrylate, trimethylolpropane trimethacrylate, trimethylolethane trimethacrylate, aluminum methacrylate, zinc methacrylate, calcium methacrylate, magnesium methacrylate, diallylphthalate, triallylcyanurate, triallylisocyanurate, triallyl trimellitate, and ethyleneglycol diglycidylether acrylate.

In the mixture (C), the molar ratio of the monoacrylate compound to the ethylenically unsaturated monomeric compound is preferably in the range of from 60:40 to 99:1, more preferably from 70:30 to 90:10.

The precursory antistatic material can be directly applied to the carpet when the material is in the liquid state. The precursory antistatic material may be applied in the state of a solution or emulsion thereof in a volatile medium. In this case, the precursory antistatic material in the solution or emulsion is preferably in a concentration of from 20% to 80% by weight, more preferably, from 30% to 60% by weight.

The volatile medium consists essentially of at least one solvent having a low boiling point, preferably of 100° C. or less, and a low viscosity, preferably of 20 cps or less.

For example, the volatile medium consists essentially of at least one member selected from the group consisting of water and aliphatic alcohols having 1 to 3 carbon atoms, for example, methyl alcohol, ethyl alcohol, and propyl alcohols. Water is a very important medium for the precursory antistatic material because water is non-toxic, easily evaporates, and is cheap. Therefore, an aqueous medium, for example, water alone or a mixture of water with a lower aliphatic alcohol such as methyl alcohol or ethyl alcohol, is very preferable for the present invention.

The antistatic material can contain a small amount of an additive in addition to the above-mentioned bi-functional compound (A), mixture (B), and/or mixture (C). The additive may consist of at least one member selected from the group consisting of, for example, sensitizing agents, dispersing agents for the sensitizing agents, surface-active agents which are effective for promoting even penetration of the precursory antistatic material into the surface portion of the carpet, antioxidants, and coloring agents.

The sensitizing agents may be selected from commercially available products, for example, a 70% solution of Darocur 1116 (trademark of Merck Co.) which solution has been prepared by Takemoto Oil and Fat Co.

The sensitizing agents may comprise, for example, 1-(4-isopropylphenyl)-2-hydroxy-2-methylpropane-1-on-benzophenone compounds.

The surface active agents may be selected from commercially available anionic and non-ionic surfactants, for example, NT-7A (trademark of non-ionic surfactant produced by Takemoto Oil and Fat Co.), AT-6-J (trademark of anionic surfactant produced by Takemoto Oil and Fat Co.). The surface active agent added to the precursory antistatic material is effective for preventing undesirable contact of drops of the precursory antistatic material applied to the pile surface layer, especially, the cut pile surface layer of the carpet, with each other. Such contact of the precursory antistatic material would result in bonding of top end portions of adjacent piles to each other when the precursory antistatic material drops are solidified. This phenomenon would cause the resultant carpet surface to exhibit an undesirable rigid touch.

It is preferable that the surface portion of the carpet be uniformly impregnated up to a depth of from 0.1 to 2 mm from the upper (outer) surface of the carpet, with 0.5 to 100 g/m$^2$ of the precursory antistatic material.

When the impregnating operation is carried out by a spraying method, a high pressure spraying process is more preferable than a usual air pressure (low pressure) spraying process. In the usual air pressure spraying process, the air pressure is usually several kg/cm$^2$ or less. This air pressure is not high enough to uniformly spray the precursory antistatic material or its solution or emulsion into small particles. Also, in the usual air pressure spraying process, a mixture of an air stream and small particles of the precursory antistatic material or its solution or emulsion is ejected toward the carpet surface through a spray nozzle. Therefore, a portion of the ejected mixture escapes into the ambient atmosphere. That is, the amount of the precursory antistatic material reaching the carpet surface is only 20% to 50% based on the entire weight of the precursory antistatic material used. Furthermore, in the case of the usual air pressure spraying process, the sprayed precursory antistatic material or its solution or emulsion can penetrate into the surface portion of the pile layer only to a depth of less than 0.2 mm. That is, the usual air pressure spraying process is not satisfactory to cause the precursory antistatic material or its solution or emulsion to reach a depth of 0.2 mm or more from the outer surface of the pile layer.

A high pressure spraying process is carried out preferably under an air pressure of 10 kg/cm$^2$ or more, more preferably, 25 kg/cm$^2$ or more. Under this pressure condition, the precursory antistatic material or its solution or emulsion is divided into extremely fine particles. For example, when the spraying operation is carried out under a pressure of 30 kg/cm$^2$, the size of the resultant particles is about 100 to 150 microns. The higher the pressure, the smaller the size of the resultant particles of the precursory antistatic material or its solution or emulsion. Also, when the spraying operation is carried out under a high pressure, the amount of the precursory antistatic material or its solution or emulsion impregnated in the surface portion of the pile layer significantly increases to, for example, 80% based on the entire weight of the precursory antistatic material or its solution or emulsion used. Furthermore, when the spraying operation is carried out under a high pressure, a large amount of dynamic energy is imparted to the resultant fine particles of the precursory antistatic material or its solution or emulsion. These highly activated fine particles can easily penetrate into the surface portion of the pile layer and can reach a depth of about 2 mm or more from the outer surface of the pile layer. The depth of the impregnated surface portion can be controlled by controlling the spraying pressure, the conditions of the precursory antistatic material or its solution or emulsion, and the speed of the carpet in relation to the spraying nozzle.

In the case of a loop pile carpet which is not converted to a cut pile carpet, a depth of the precursory antistatic material-impregnated surface portion of the pile layer of 0.1 mm or more is sufficient. When the loop pile carpet is converted into a cut pile carpet by cutting the loop piles, however, usually the top portions of the cut piles, having a length of 0.5 mm, are cut and removed. Accordingly, in order to leave a 0.1 mm or more deep impregnated surface portion after the cutting operation, it is necessary that the surface portion of the loop pile carpet be impregnated to a depth of at least 0.6 mm.

In the continuous spraying of the precursory antistatic material or its solution or emulsion toward the upper surface of the carpet, the carpet is moved along a predetermined path thereof at a predetermined velocity. A spray tip equipped with a spray nozzle moves reciprocally and laterally to the longitudinal direction of the moving path of the carpet so as to traverse it, while spraying the precursory antistatic material or its solution or emulsion toward the carpet surface. In this case, should the carpet move at a predetermined velocity and the spray tip stop, the pattern of the area to which the precursory antistatic material or its solution or emulsion is sprayed through a spray nozzle is an oval.

When a carpet having a width W cm moves at a velocity of $V_c$ cm/sec, the spray tip moves at a velocity of $V_t$ cm/sec, and the area to which the precursory antistatic material-spraying operation is applied has a longitudinal length L cm measured along the longitudinal direction of the moving path of the carpet, it is preferable that the following relationship be satisfied.

$$L = \frac{W}{V_t} \times V_c \times 2$$

The precursory antistatic material contained in the surface portion of the pile layer of the carpet is cross-linked by heating it at an elevated temperature and/or by applying ultraviolet rays, radiation, and/or an electric discharge thereto.

When the precursory antistatic material is applied in the state of a solution or emulsion in a volatile medium to the carpet surface, the surface portion impregnated with the solution or emulsion is dried by evaporating the volatile medium at a temperature of from 50° C. to 130° C. before, after or during the cross-linking treatment. The type, intensity, and conditions of the cross-linking operation are variable depending on the type and surface configuration of the carpet and the type and amount of the precursory antistatic material.

When the cross-linkage of the precursory antistatic material is attained by the heating operation, the precursory antistatic material is heated at a temperature of 80° C. to 150° C. for 5 to 30 minutes. In the case of ultraviolet rays, the carpet is placed in an location 10 to 20 cm spaced from a ultraviolet ray lamp, for example, a high pressure mercury lamp having a power consumption of 40 to 80 W/cm, and ultraviolet rays are applied to the surface of the carpet for 5 to 30 seconds.

In the case of the heat cross-linking, it is preferable that a heat reaction initiator consisting of, for example, azo-bis-isobutylonitrile, benzoylperoxide, lauroyl peroxide, cumene hydroperoxide and/or tert-butylperoxide, be added to the precursory antistatic material to promote the heat cross-linking reaction.

In the case of ultraviolet ray cross-linking, it is preferable that a sensitizing agent consisting of, for example, benzophenone, benzoin, benzil and/or their derivatives, be added to the precursory antistatic material to accelerate the cross-linking reaction.

The amount of the precursory antistatic material to be applied to the pile layer surface portion of the carpet is variable depending on the type of the precursory antistatic material, the pile layer surface conditions of the carpet, and the desired intensity of antistatic property to be imparted to the carpet. Preferably, the precursory antistatic material is applied in an amount of from 0.5 to 100 g, more preferably from 5 to 30 g, per m$^2$ of the carpet surface thereto.

In FIG. 1, which shows a explanatory cross-sectional profile of an antistatic carpet of the present invention, a substrate sheet 1 has a surface pile layer 2 formed on the upper surface thereof and consisting essentially of a number of pile yarns 3 extending from the substrate sheet 1. The root portions of the pile yarns 3 are embedded within the substrate sheet 1 and bonded thereto with a bonding material. The substrate sheet 1 has a backing layer 5 formed on the lower surface.

The top end portions of the pile yarns 3 are impregnated or coated with an antistatic material layer 4 to a depth of 0.1 to 2 mm from the upper surface of the carpet. Since the antistatic material used in the process of the present invention can impart an excellent antistatic property to the carpet, a small depth of 0.1 to 2 mm is sufficiently large to cause the resultant carpet to be highly antistatic.

Figure 2:
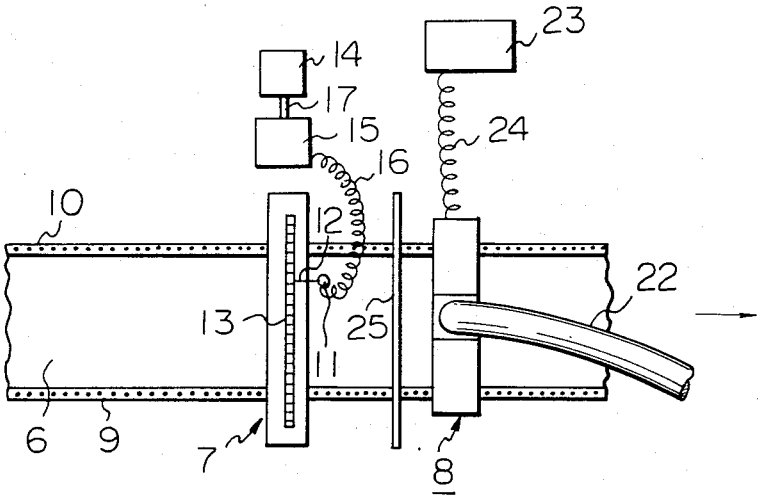
FIG. 2 is an explanatory front view of an apparatus for carrying out the process of the present invention.
Figure 3:
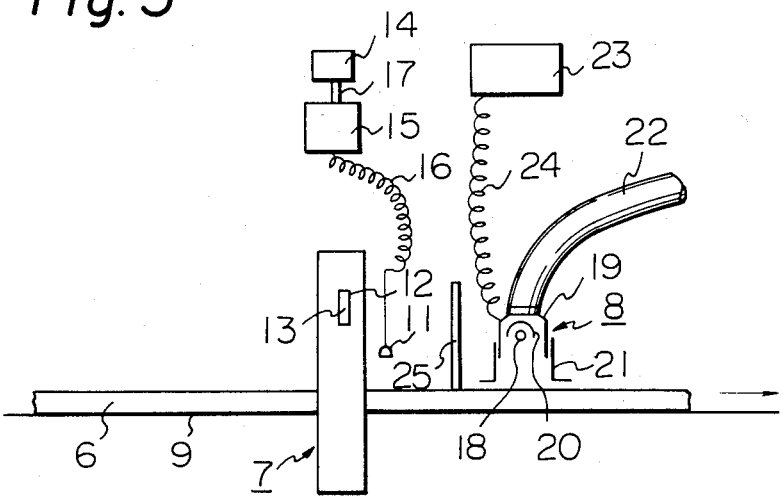
FIG. 3 is an explanatory cross-sectional side view of the apparatus indicated in FIG. 2.

Referring to FIGS. 2 and 3, which show an apparatus for carrying out the process of the present invention, a carpet 6 moves in a direction indicated by the arrow. An apparatus 7 for spraying a precursory antistatic material or its solution or emulsion is arranged above the moving path of the carpet 6. An apparatus 8 for applying ultraviolet rays to the carpet 6 is arranged above the carpet 6 and downstream from the spraying apparatus 7.

The carpet 6 is placed on an endless conveyer 9 and is fixed thereon with a number of fixing needles 10 located in the side edge portions of the conveyer 9.

The spraying apparatus 7 is provided with a spray tip 11 supported by a guide bar 12. The bar 12 is also connected to a chain 13 which is capable of moving reciprocally at right angles to the longitudinal direction of the carpet 6 so as to allow the spray tip 11 to reciprocally traverse the carpet 6.

A tank 14 contains therein a precursory antistatic material or its solution or emulsion and is connected to a high pressure pump. The precursory antistatic material or its solution or emulsion is supplied from the tank 14 through a conduit 17, the high pressure pump 15, and a flexible conduit 16 to the spray tip 11 and is sprayed through the spray tip 11 toward the upper surface of the carpet 6 under a high pressure generated by the high pressure pump 15. In this spraying operation, the spray tip reciprocally moves laterally so as to traverse the carpet.

The ultraviolet ray-applying apparatus 8 is provided with an ultraviolet ray lamp 18, a lamp house 19, an ultraviolet ray-reflecting plate 20, a pair of ultraviolet ray-masking shield 21, and a duct 22 for discharging air used for cooling the lamp 18 to a desired temperature. The ultraviolet ray lamp 18 is connected to an electric power source 23 through a flexible electric cord 24.

A partition plate 25 is arranged between the spraying apparatus 7 and the ultraviolet ray-applying apparatus 8 to protect the apparatus 8 from the mist of precursory antistatic material sprayed from the apparatus 7.

Figure 4:
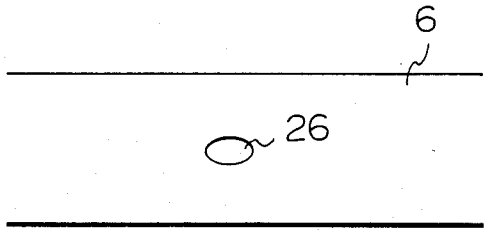
FIG. 4 is a pattern of an area to which a precursory antistatic material is sprayed through a spraying nozzle.

Referring to FIGS. 2 and 3, the carpet 6 fixed on the conveyer 9 with the needles 10 moves together with the conveyer in the direction shown by the arrow. A precursory antistatic material or its solution or emulsion is fed from the tank 14 into the spray tip 11 through the conduit 17, the high pressure pump 15, and the flexible conduit 16 under a high pressure. The spray tip 11 moves reciprocally by means of the bar 12 and the chain 13 so as to traverse the carpet at right angles to the longitudinal direction of the carpet. The precursory antistatic material or its solution or emulsion is sprayed through the spray tip 11 toward the upper surface of the carpet 6 under a high pressure. This spraying operation is preferably carried out so as to satisfy the previously described relationship.

$$\frac{W}{V_t} \times V_c \times 2 = L$$

wherein W represents a width in cm of the carpet, $V_t$ represents a velocity in cm/sec of the spray tip, $V_c$ represents a velocity in cm/sec of the carpet and L represents a length in cm of an area of the carpet surface which is impregnated with the precursory antistatic material. Referring to FIG. 4, when the carpet moves but the spray tip does not move, the area 26 of the surface of the carpet 6 impregnated with the sprayed precursory antistatic material is in the form of a oval. The length of the oval area 26 measured in the longitudinal direction of the carpet corresponds to the above-mentioned length L. In this spraying operation, the top end portions of the pile yarns in the carpet are impregnated or coated with the precursory antistatic material at a depth of 0.1 to 2 mm from the upper surface of the carpet.

When the impregnated carpet surface comes below the ultraviolet ray-applying apparatus 8, ultraviolet rays are irradiated toward the surface of the carpet so as to cross-link and harden the precursory antistatic material while, if necessary, the volatile medium evaporates and is eliminated.

The resultant antistatic carpet exhibits a satisfactory antistatic property and an excellent durability in antistatic property.

SPECIFIC EXAMPLES OF THE INVENTION

The following examples are presented for the purpose of clarifying the present invention. It should be understood, however, that these are intended only as illustrations of the present invention and are not intended to limit the present invention in any way.

In the examples, the abrasion of a carpet and electric potential of a human body charged with static electricity were determined in the following manner.

(1) Accelerated Abrading Treatment

An abrading piece was prepared by arranging and fixing two pieces of cowhide each having a thickness of 4 mm, a width of 25 mm, and a length of 300 mm, parallel to each other at a space of 50 mm. A test specimen having a length of 70 cm and a width of 40 cm was prepared from a carpet to be tested.

The abrading piece was placed on the surface of the carpet specimen and continuously abraded the carpet specimen surface at a rate of 40 times/min of the reciprocal abrading motions under a load of 10 kg for 4 hours so as to wear down the surface of the carpet.

(2) Static Charge Test

A non-abraded carpet specimen and an abraded carpet specimen were conditioned at a temperature of 20° C. at a relative humidity of 30% for 24 hours. A person walked in an ordinary manner on each of the specimens placed on an electrically insulated floor at 20° C., at a relative humidity of 30% for 5 minutes. The same walking procedure as that mentioned above was repeated, except that the person slid his feet so as to rub the carpet specimen surface with the soles of his shoes. After walking, the electric potential of the person's body was measured, in accordance with Japanese Industrial Standard (JIS) 1021-1974.

EXAMPLE 1

A precursory antistatic material consisting of 100 parts by weight of methyltetraglycol acrylate and 10 parts by weight of trimethylolpropane triacrylate was mixed with 3 parts by weight of a heat cross-linking catalyst consisting of benzoyl peroxide. The resultant mixture was fed to a spray tip in the spraying apparatus as indicated in FIGS. 2 and 3.

A cut pile carpet consisting of nylon 6 fiber yarns and having a width of 100 cm was fed to the apparatus and longitudinally moved at a velocity of 4 cm/sec. The spray tip as laterally moved at a velocity of 50 cm/sec and the mixture was sprayed to the cut pile carpet surface through the spray tip under a pressure of 30 kg/cm$^2$. The length L of the sprayed oval area was 16 cm. The precursory antistatic material was applied in an amount of 25 g/m$^2$ to the surface portion of the carpet and penetrated up to a depth of 2.0 mm.

The precursory antistatic material-impregnated carpet surface portion was heated at a temperature of about 110° C. for 20 minutes.

The resultant cross-linked carpet was subjected to the abrading treatment and the static charge test.

For the purpose of comparison, the same treatment and test as those mentioned above were applied to the corresponding non-antistatic carpet.

The results are indicated in Table 1.

TABLE 1

| Abrading time (hr) | Electric potential of charged human body (V) | | | |
|---|---|---|---|---|
| | Non-antistatic carpet | | Antistatic carpet | |
| | Ordinary walk | Sliding walk | Ordinary walk | Sliding walk |
| 0 | 2,000 | 2,000 | 100 | 150 |
| 4 | 2,500 | 2,900 | 800 | 1,200 |

EXAMPLE 2

A precursory antistatic material consisting of the compound of the formula:

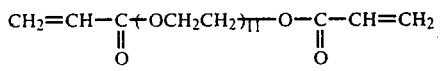

was mixed in an amount of 100 parts by weight with 3 parts by weight of an ultraviolet ray sensitizing agent consisting of benzophenone. The resultant solution was applied to a surface portion of a loop pile carpet composed of polyethylene terephthalate fiber yarns and having a width of 120 cm, in the same manner as that described in Example 1.

In the spraying procedure, 10 g/m$^2$ of the applied precursory antistatic material was caused to penetrate into the carpet surface portion up to a depth of 1.5 mm.

The impregnated carpet was subjected to an ultraviolet ray treatment by using the ultraviolet ray-irradiating apparatus indicated in FIGS. 2 and 3. In the apparatus, the ultraviolet ray lamp was of a power consumption of 80 W/cm. The carpet moved 20 cm below the ultraviolet ray lamp at a velocity of 3 m/min.

The results of the test are indicated in Table 2.

TABLE 2

| Abrading time (hr) | Electric potential of charged human body (V) | | | |
|---|---|---|---|---|
| | Non-antistatic carpet | | Antistatic carpet | |
| | Ordinary walk | Sliding walk | Ordinary walk | Sliding walk |
| 0 | 1,350 | 1,580 | 40 | 10 |
| 4 | 2,130 | 2,920 | 780 | 1,100 |

EXAMPLE 3

The same procedures as those described in Example 2 were carried out except that the precursory antistatic material consisted of a compound of the formula:

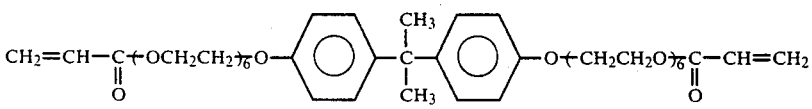

and the loop pile carpet was composed of nylon 6 fiber yarns and had a width of 120 cm.

The results of test were as indicated in Table 3.

TABLE 3

| Abrading time (hr) | Electric potential of charged human body (V) | | | |
|---|---|---|---|---|
| | Non-antistatic carpet | | Antistatic carpet | |
| | Ordinary walk | Sliding walk | Ordinary walk | Sliding walk |
| 0 | 450 | 3,000 | 0 | 200 |
| 4 | 1,300 | 4,500 | 300 | 800 |

We claim:

1. A process for producing an antistatic carpet, comprising:

impregnating only a surface portion of a carpet with a precursory radiation curable antistatic material consisting essentially of at least one member selected from the group consisting of (A) bi-functional compounds from the group consisting of one or both of the formulae (I) and (II):

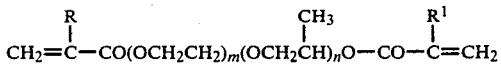

(I)

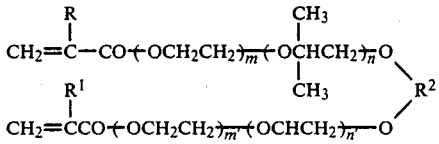

(II)

wherein R and R$^1$ represent, independently from each other, a member selected from the group consisting of a hydrogen atom and a methyl radical, R$^2$ represents a divalent radical selected from the group consisting of those of the formulae:

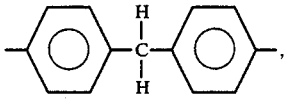

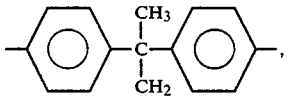

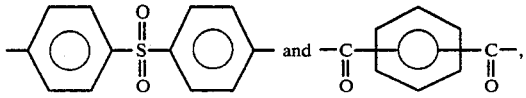

wherein m and m' represent, independently from each other, zero or an integer of from 1 to 100 and n and n' represent, independently from each other, zero or an integer of from 1 to 200, when one of m and n is zero, the other being not zero, and when one of m' and n' is zero, the other being not zero, and mixtures thereof, (B) mixtures of at least one bi-functional compound selected from those of the formulae (I) and (II) with at least one compound having at least one ethylenically unsaturated bond and capable of reacting with said bi-functional compound, and (C) mixtures of at least one mono-functional compound selected from the group consisting of those of the formula (III):

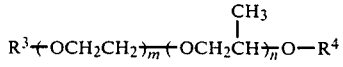

(III)

wherein one of $R^3$ and $R^4$ represents a radical of the formula (IV):

$$CH_2{=}\overset{\overset{\displaystyle R^5}{|}}{C}{-}CO{-} \qquad (IV)$$

and the other represents a member selected from the group consisting of a hydrogen atom and inorganic and organic radicals different from those of the formula (IV), m and n are as defined above, and $R^5$ in the formula (IV) represents a member selected from the group consisting of a hydrogen atom and a methyl radical, with at least one monomeric compound having at least two ethylenically unsaturated bonds and capable of copolymerizing with said monoacrylate compound to an extent that said precursory antistatic material penetrates into said surface portion of said carpet up to a depth of from 0.1 to 2 mm from the upper surface of said carpet; and irradiating said precursory antistatic material in said carpet surface portion to cure it.

2. A process as claimed in claim 1, wherein in said mixture (B), said diacrylate compound and said ethylenically unsaturated monomeric compound are in a molar ratio of from 40:60 to 90:10.

3. A process as claimed in claim 1, wherein in said mixture (C), said monoacrylate compound and said ethylenically unsaturated monomeric compound are in a molar ratio of from 60:40 to 99:11.

4. A process as claimed in claim 1, wherein said precursory antistatic material is in the state of a solution or emulsion thereof in a volatile medium.

5. A process is claimed in claim 4, wherein said volatile medium consists of at least one member selected from the group consisting of water and alkyl alcohols having 1 to 3 carbon atoms.

6. A process as claimed in claim 1, wherein said impregnating procedure is carried out by spraying said precursory antistatic material toward said carpet surface under a high pressure.

7. A process as claimed in claim 1, wherein said precursory antistatic material solution or emulsion contains a sensitizing agent consisting of at least one member selected from the group consisting of benzophenone, benzoin, benzil and their derivatives.

8. A process as claimed in claim 1, wherein said precursory antistatic material is applied in an amount of from 0.5 to 100 g per $m^2$ of said carpet surface, thereto.

9. A process as claimed in claim 1, wherein said crosslinking procedure is effected by irradiating ultraviolet rays from an ultraviolet ray lamp to said precursory antistatic material in said carpet surface portion.

10. An antistatic carpet produced by the process as claimed in claim 1, 2, 3, 4, 5, 6, 7 or 8.

* * * * *